US007481670B2

(12) United States Patent
Chen

(10) Patent No.: US 7,481,670 B2
(45) Date of Patent: Jan. 27, 2009

(54) QUICK SECURE CONNECTION SYSTEM FOR OUTDOOR LIGHTING SYSTEMS

(75) Inventor: Chi Gon Chen, Gueng Zhou (CN)

(73) Assignee: International Development Corp., Roanoke, TX (US)

( * ) Notice: Subject to any disclaimer, the term of this patent is extended or adjusted under 35 U.S.C. 154(b) by 0 days.

(21) Appl. No.: 11/784,495

(22) Filed: Apr. 6, 2007

(65) Prior Publication Data

US 2008/0084711 A1 Apr. 10, 2008

Related U.S. Application Data

(60) Provisional application No. 60/850,365, filed on Oct. 6, 2006.

(51) Int. Cl.
*H01R 11/00* (2006.01)

(52) U.S. Cl. ..... 439/505; 439/664; 439/675; 362/252; 362/391; 362/650

(58) Field of Classification Search ..... 439/502, 439/505, 664, 675; 362/250, 252, 391, 647, 362/649, 650, 653, 654, 806, 807
See application file for complete search history.

(56) References Cited

U.S. PATENT DOCUMENTS 2,610,266 A * 9/1952 Greeson ..... 200/51.09
3,295,096 A * 12/1966 Gillespie et al. ..... 439/651
3,504,169 A * 3/1970 Freeburger ..... 362/249
4,352,539 A * 10/1982 Vest ..... 439/236
4,571,018 A * 2/1986 Annoot ..... 439/281
5,150,964 A * 9/1992 Tsui ..... 362/251
5,453,916 A * 9/1995 Tennis et al. ..... 362/152
5,641,241 A * 6/1997 Rushing ..... 404/6
5,813,885 A * 9/1998 Shen ..... 439/699.2
6,091,200 A * 7/2000 Lenz ..... 315/159
7,264,515 B1 * 9/2007 Rubinstein ..... 439/664
2002/0106931 A1 * 8/2002 Hsien-Te ..... 439/490
2008/0084711 A1 * 4/2008 Chen ..... 362/648
2008/0158865 A1 * 7/2008 Chen ..... 362/183
2008/0211412 A1 * 9/2008 Chen ..... 315/152

* cited by examiner

*Primary Examiner*—James Harvey
(74) *Attorney, Agent, or Firm*—David W. Carstens; Carstens & Cahoon, LLP

(57) ABSTRACT

A quick secure connection system for use with a set of outdoor lights includes a power source having a two-wired female connector surrounded by external threads. Threadably connected to the female connector on the power source is a male connector surrounded by an internally threaded collar. The male connector is mounted on one end of a power transmission cord.

On the opposite end of the power transmission is a two-wired light assembly. On the base of the two-wired light assembly is another two-wired female connector from which a set of outdoor lights may be assembled.

9 Claims, 7 Drawing Sheets

QUICK SECURE CONNECTION SYSTEM FOR OUTDOOR LIGHTING SYSTEMS

CROSS REFERENCE TO RELATED APPLICATION

This application claims the benefit of Provisional U.S. Patent Application 60/850,365, filed Oct. 6, 2006.

STATEMENT REGARDING FEDERALLY FUNDED RESEARCH AND DEVELOPMENT

This invention described in this patent application was not the subject of Federally sponsored research or development.

FIELD

The present invention pertains to outdoor lighting systems; more particularly, present invention pertains to outdoor lighting systems typically used near walkways, driveways, gardens, flowerbeds, and the like where a set of individual outdoor lights are electrically connected one to another by a power cord.

BACKGROUND

In recent years, it has become common for home owners to add outdoor lighting systems to areas surrounding or extending from their residences. Many home owners use outdoor lighting systems to provide illumination of footpaths leading from entrances. Other home owners use a set of outdoor lights to mark driveways. Still other home owners use outdoor lighting to provide a unique effect in a flower bed or near shrubs. And still others use outdoor lighting to border a patio or an outdoor living space.

The outdoor lighting products that most are familiar to homeowners include a set of low voltage lights wherein each low voltage light is enclosed within a decorative housing, a transformer which reduces the voltage of house current to the level of the of the low voltage bulbs in each fixture, and a power cord extending from the transformer to each of the individual outdoor lights. The power cord is generally buried in the soil between each light fixture.

In some new sets of outdoor lighting products a single solar panel assembly is used to gather light energy during daylight hours and transform the light energy into electrical energy. The electrical energy is stored in a battery until needed typically during the early evening hours. When desired, the stored electrical energy is directed from the battery to the individual outdoor lights using a power cord.

To provide maximum flexibility for placement of individual light fixtures, many sets of low voltage lights include pin connectors. The pin connectors may be placed at selected locations along the power cord. Such pin connectors include a split housing. Inside the split housing are pins which are connected to the electrical leads for each light source. The power cord is placed within the split housing when the split housing is open at the location along the power cord where the light fixture is to be placed. The split housing is then closed and the pins within the split housing are used to pierce the insulation on the power cord to make an electrical connection with the metal wires located under the insulation within the power cord.

Those who have attempted to set up an outdoor lighting system using pin connectors with a split housing have often experienced the frustration of not making the desired electrical connection between the pin and the metal wires after the split housing has been closed around the power cord. In such cases, it is necessary to re-open the split connector and attempt to create another piercing of the insulation portion of the power cord with the pins located inside the pin connector. Since the insulation around the power cord is generally not self sealing, a small opening will be left in the insulation by the prior failed attempt to make an electrical connection. Such small opening in the insulation is potentially dangerous if the light fixture and power cord are placed in moist soil.

Even if a successful electrical connection is made by the second piercing of the insulation with the pins inside the pin connector, the electrical connector is not sealed and remains open to the corrosive effects of moisture and the chemicals in the soil. Thus some home owners have found that while the lighting system using pin connectors may operate properly for several months, it will fail prematurely because of corroded wires within the power cord.

Some home owners have experienced the frustration of having one outdoor fixture in a string of outdoor fixtures fail. The solution is to remove the failed light fixture and replace it with another light fixture. However, replacing a light fixture using prior art pin connectors leaves more holes in the insulation and a greater chance for moisture and the corrosive elements contained within the soil to attack the metal wires in the power cord.

Yet other homeowners desire to change out the styles of light fixtures being used. Such change requires removing the old light fixtures and replacing them with new ones. As in the previous situation, changing out styles of light fixtures may eventually destroy the insulation around the power cord and cause corrosion of the metal wires within the power cord.

Accordingly, there remains a need in the art for a more secure connection system that is usable with outdoor lighting systems used along walkways, driveways, flower beds, patios and the like which provides for rapid, secure connection between light fixtures.

SUMMARY

The present invention relates to a quick secure connection system that is usable with outdoor lighting system including a small group of individual light fixtures.

The disclosed quick secure connection system for outdoor lighting systems includes an externally threaded female electrical connector attached to a power source and to the base of each light fixture. Connecting a light fixture in the string of light fixtures to the power source and to the remaining light fixtures is a power cord having a male electrical connector on one end. The male electrical connector is surrounded by an internally threaded collar which is threadably engaged with the external threads surrounding the female electrical connector.

BRIEF DESCRIPTION OF THE DRAWING FIGURES

A still better understanding of the quick secure connection system for outdoor lighting systems of the present invention may be had by reference to the drawing figures wherein.

DESCRIPTION OF THE EMBODIMENTS

The disclosed invention is designed for use with outdoor lighting systems whether powered by house current run through a transformer or powered by solar panels.

Figures 1A, 1B, 1C:
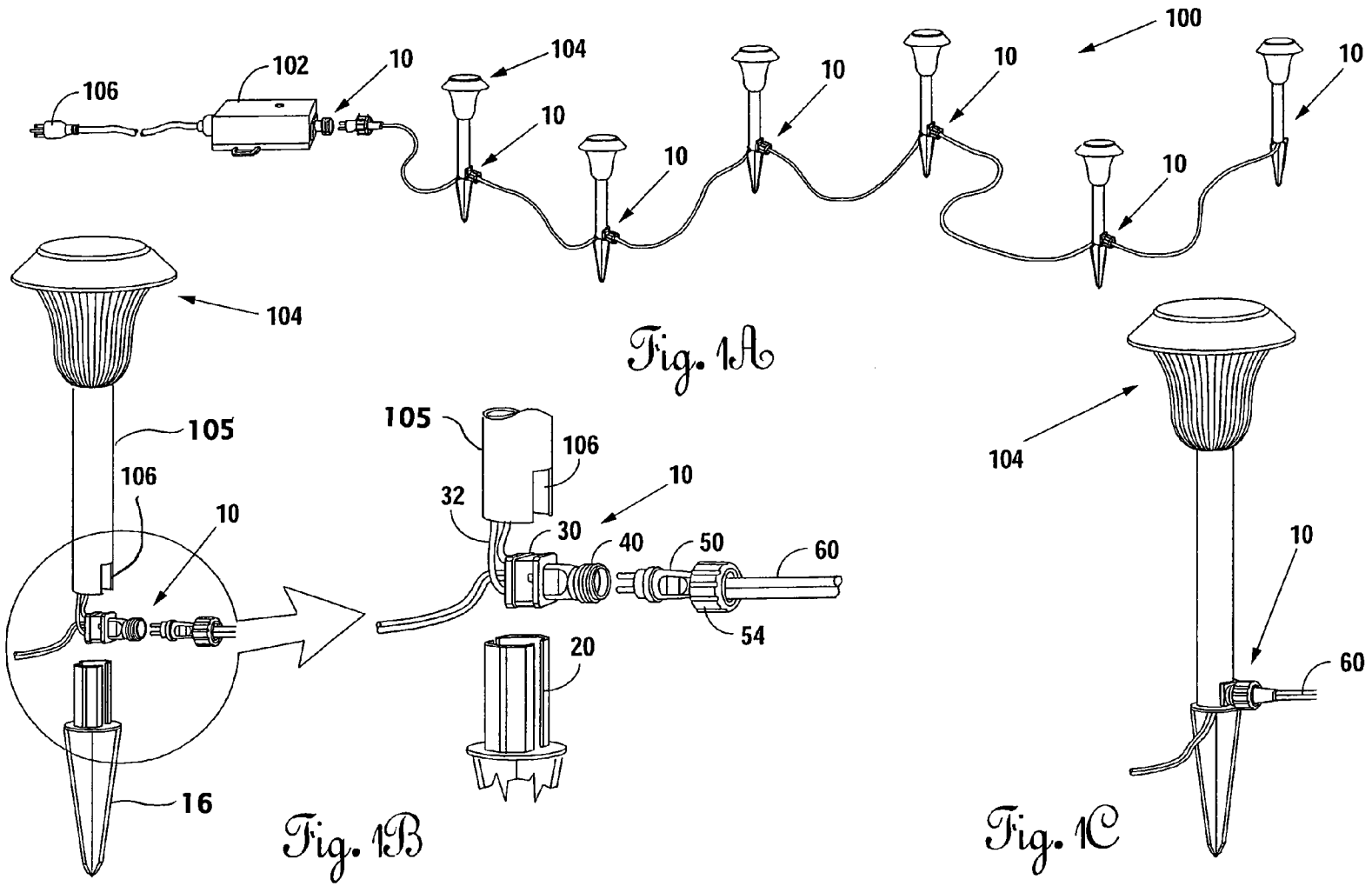
FIG. 1A is a perspective view of an outdoor light system designed for use with house current including a transformer and employing the quick secure connection system of the present invention.
FIG. 1B is a perspective view of an individual light fixture taken from FIG. 1A including an exploded view of the quick secure connection system of the present invention.
FIG. 1C is an enlarged perspective view of a light fixture with an assembled quick secure connection taken from FIG. 1A.

As may be seen in FIG. 1A, the outdoor lighting system 100 in which the disclosed invention is included is designed to use a standard plug 106 which connects to an outlet for 120 v AC house current. The 120 vAC house current is reduced in voltage with a transformer 102. As will be shown in FIGS. 1B and 1C, the quick secure connection system 10 of the present invention is used to make a power output connection with the transformer 102.

The low voltage electrical output of the transformer 102 is then supplied to a plurality of outdoor light fixture assemblies 104 which may be placed at various locations as desired. As shown in FIG. 1B at the bottom of each light fixture light fixture assembly 104 is a ground stake 16. The ground stake 16 is used to hold the light fixture in place by pressing it into the soil in a garden, lawn, flower bed or the like. As shown in FIG. 1A, the quick secure connection system 10 of the present invention is used on each light fixture assembly 104 and on the transformer 102.

In FIG. 1B an enlargement of the quick secure connection system 10 of the present invention is shown. Just above where the pole portion 105 of the light fixture assembly engages the ground stake 16 a small substantially rectangular opening 106 is formed in the bottom of the pole 105 to accommodate the mounting for the female electrical portion 40 quick secure connection system 10 of the present invention. At the top of the ground stake 16 is receiver 20. The mounting block which fits into the receiver 20 both contains the wires 32 to the lamp in the light fixture assembly 104 and provides a base for and the female electrical connector 40. The size of the mounting block 30 is such that the hollow pole 105 will slide over both the housing 30 and the receiver 20 such that the female electrical connector 40 of the quick secure connection system 10 extends outwardly from the pole 105 through the rectangular opening 106. A connection is then made with the prongs in the male electrical connector 50 of the quick secure connection system 10 by placing the prongs 52 on the male electrical connector 50 into the openings 42 of the female electrical connector 42 and threadably connecting the internal threads within the collar 54 surrounding the male electrical connector 50 with the external threads 44 surrounding the female electrical connector 40 of the connection system 10. A completed connection with an outdoor lamp appears in FIG. 1C.

Figure 2:
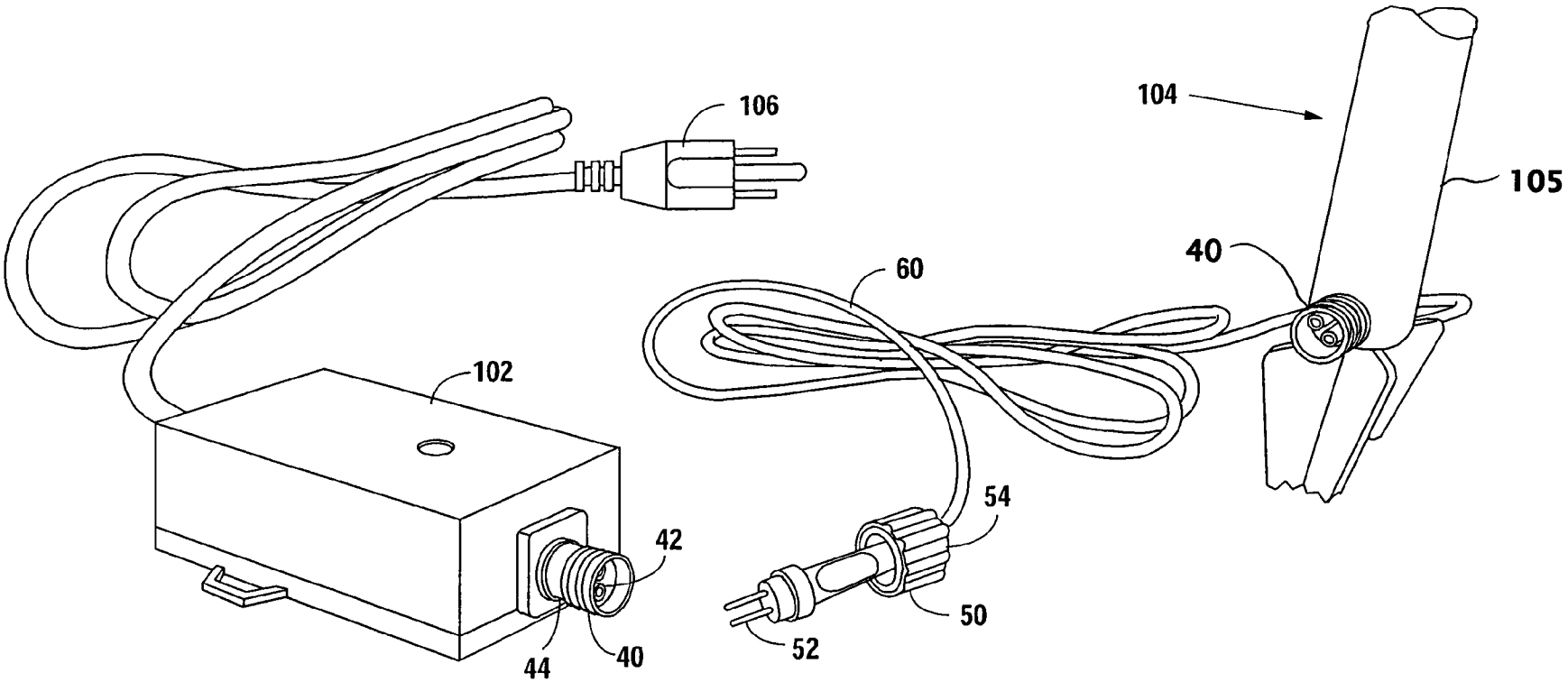
FIG. 2 is a perspective view of a transformer and the base of the pole portion of a light fixture including the disclosed invention in an unconnected state.
Figure 3:
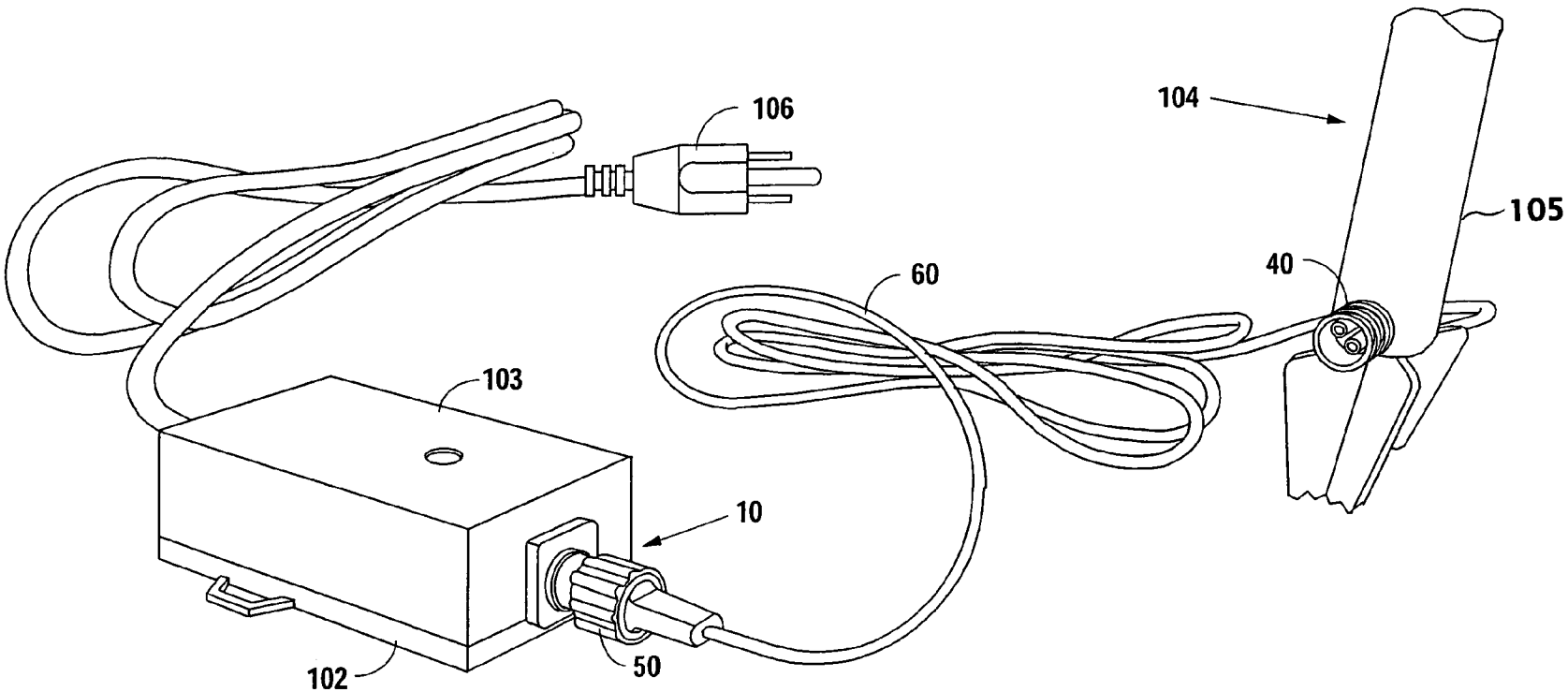
FIG. 3 is a perspective view similar to FIG. 2 but where the disclosed invention is in a connected state with the transformer.

A still better understanding of the present invention made be had by reference to FIG. 2 and FIG. 3. Therein, the transformer 102, which may be plugged into house current with a typical three prong grounded plug 106, is shown. Connected to the transformer 102 is a female electrical connector 40 surrounded by external threads 44.

The male electrical connector 50, shown in FIG. 2, is in close proximity to the female electrical connector 40 with the internally threaded collar 54 of the male electrical connector 50 pulled back to show the prongs 52. A wire 60 exits the back of the male electrical connector 50 and passes into the first light fixture assembly 104 to provide power to whatever lamp or LED is used on top of the pole 105 of the light fixture assembly 104. To enable the connection to subsequent light fixture assemblies 104, a female connection 40 is shown at the base of the pole 105 of a light fixture assembly 104.

As may be seen in FIG. 2 and in FIG. 3, the open female electrical connector 40 on the lamps will allow for the connection of another light fixture assembly 104.

Some home owners may desire to use a spot light assembly to illuminate a house number when visitors are expected or to illuminate a holiday decoration such as a wreath on a door. In such cases there may be a need to add a spot light assembly intermittently to a set of outdoor lights between similar light fixture assemblies 104. In such situations, a tee-type fitting may be added to the power cord 60 between the light fixture assemblies 104 to allow for the intermittent addition of a spotlight assembly. Those of ordinary skill in the art will understand that the tee-type fitting will typically include two female electrical connectors 40 and one male electrical connector 50.

Alternatively an ornate or decorative lighting fixture assembly may be desired for holiday decorations or decorations for a special event such as a wedding reception. By use of the quick secure connection system 10 of the present invention the home owner may be able to change out lighting fixture assemblies without the use of special tools.

Figure 4:
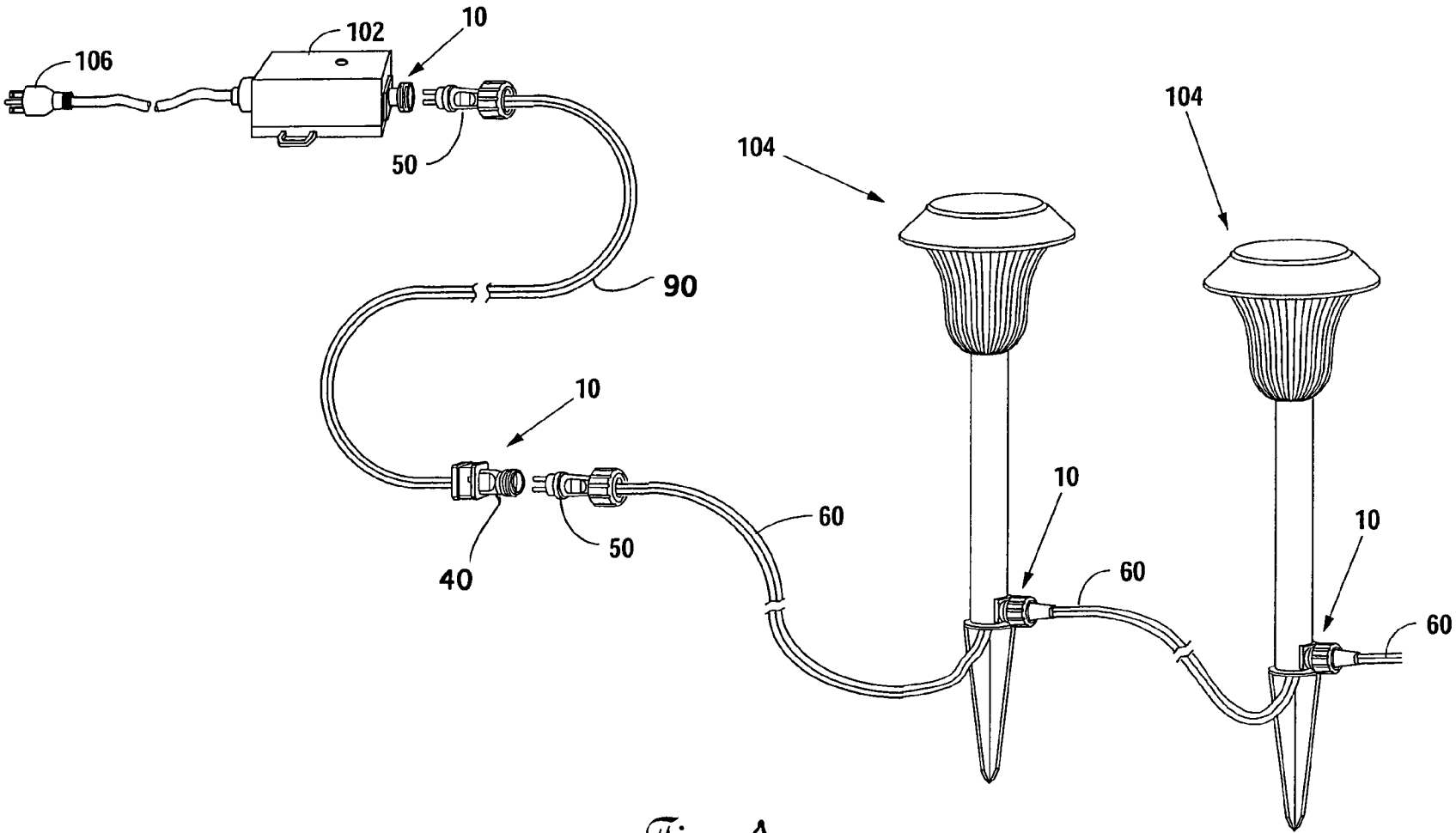
FIG. 4 is a perspective view of an outdoor light system similar to that shown in FIG. 1A but including an additional power cord segment.

In yet other situations and as shown in FIG. 4, it may be necessary to place lights 104 an extended distance apart. In the preferred embodiment the home owner is supplied with an approximately 8 foot length of power cord between lighting fixture assemblies 104. Alternatively, for situations where the light fixture assemblies 104 are to be placed apart from one another at greater distances, a 12 foot or a 16 foot length of power cord may be used. In yet other situations, an extender cord 90 with a female electrical connector 40 on one and a male electrical connector 5 on the other end as shown in FIG. 4 may be used.

Figure 5A:
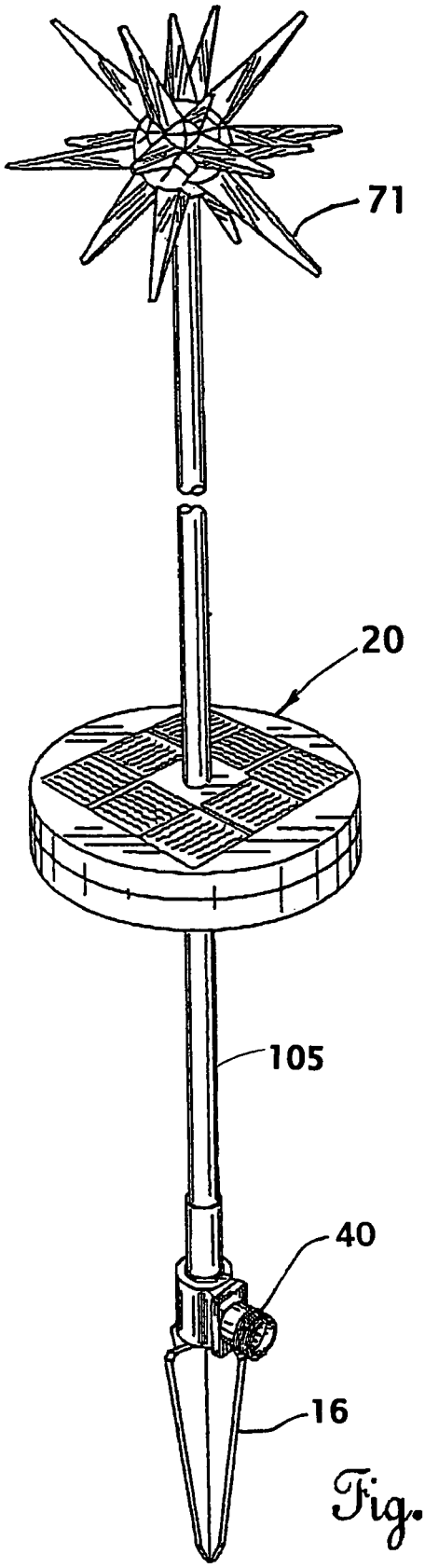
FIG. 5A is a top perspective view of a light fixture usable with an outdoor light system having a set of solar panels affixed thereto.
Figure 5B:
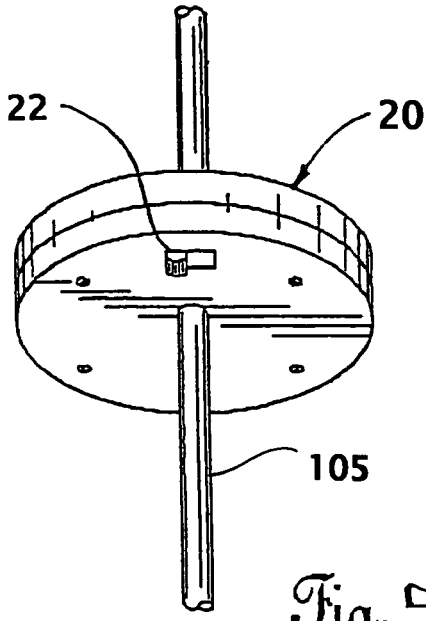
FIG. 5B is a bottom perspective view of the set of solar panels shown in FIG. 5A.

As previously indicated, power may be supplied from a set of solar panels which transform light energy into electrical energy. Shown in FIG. 5A is a set of solar panels affixed to the mounting pole 105 of a decorative light fixture including a Moravian star 71. The electrical energy needed is stored in a battery contained within the housing for the set of solar panels 20. Activation of the system occurs by moving the on-off switch 22 shown in FIG. 5B.

Figure 6:
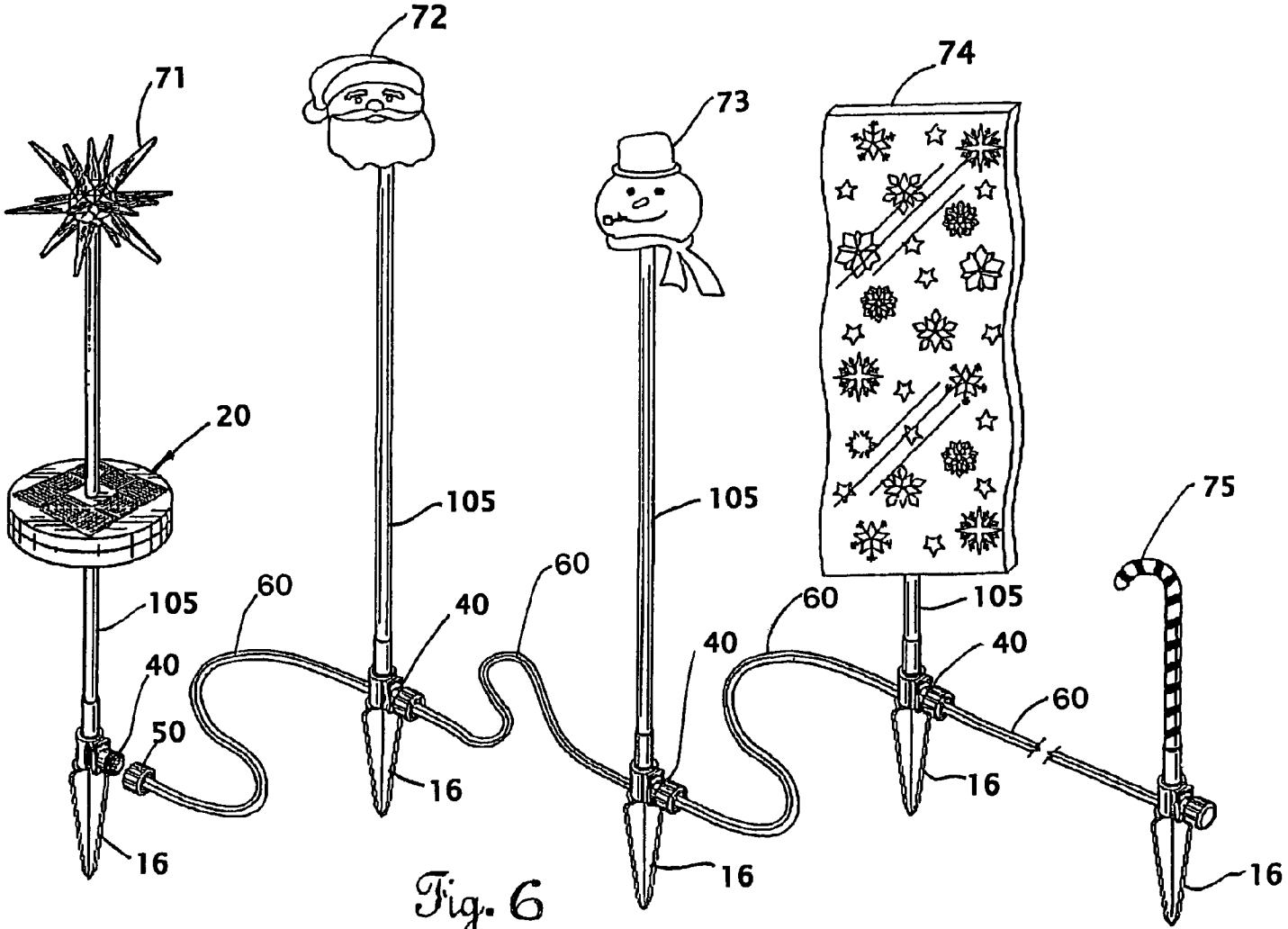
FIG. 6 is a perspective view of an outdoor light system using a solar panel set shown in FIG. 5A and employing the quick secure connection system of the present invention.

In FIG. 6 the set of solar panels 20 is shown with a variety of different decorative holiday fixtures 104 including a variety of tops 71, 72, 73, 74, and 75. Typically, when a set of solar panels 20 is used the light source used within each light fixture is an LED or an array of LED's.

Figure 7:
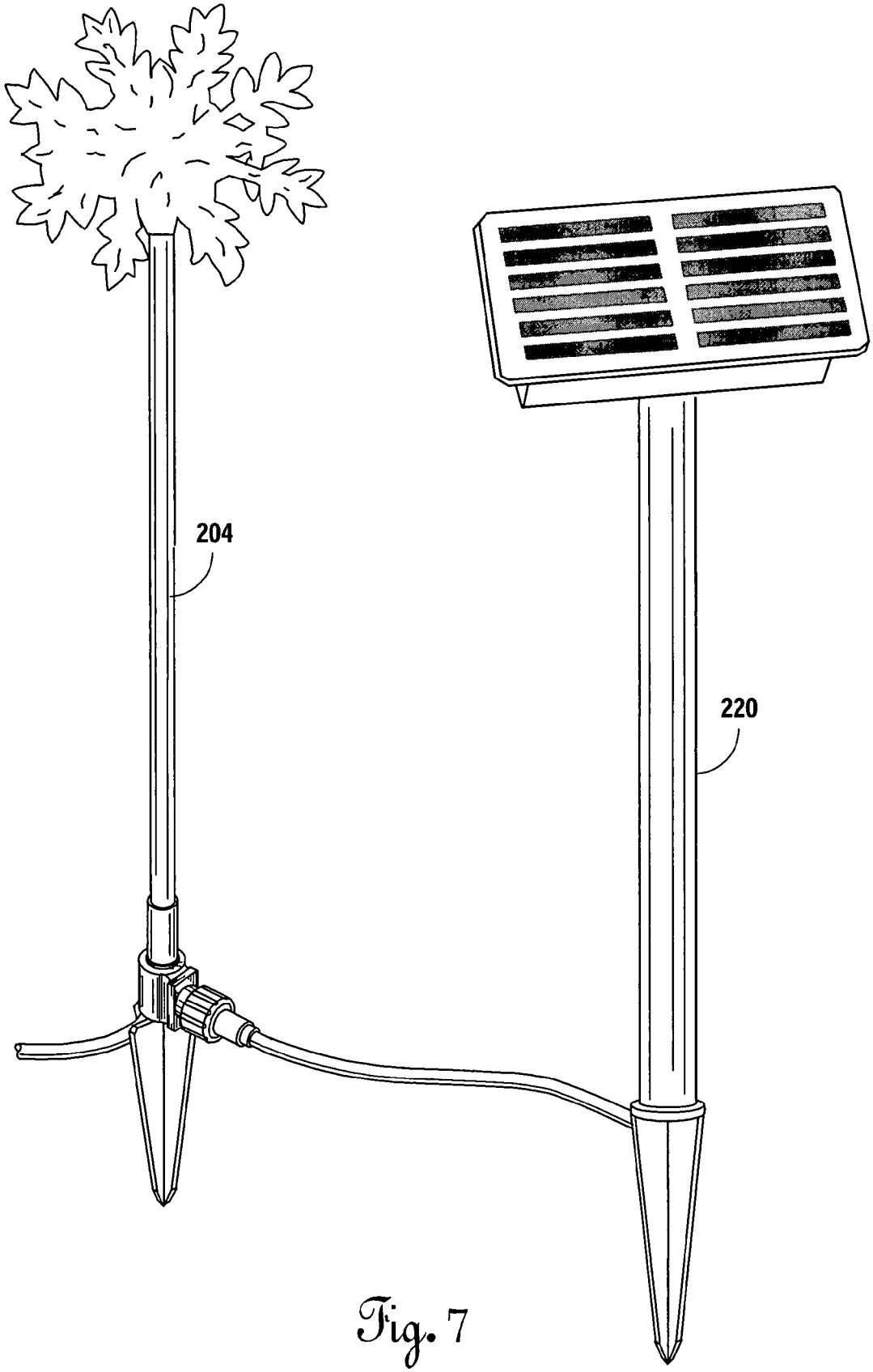
FIG. 7 is a front elevational view of an amorphous double junction solar panel connected to a snowflake fixture using the quick secure connection system of the present invention.

In FIG. 7 is an amorphous double junction solar panel 220 attached to a snowflake holiday fixture 204. The single amorphous double junction solar panel 220 will produce sufficient electrical power for a set of up to six lights.

While the present invention has been disclosed according to its preferred and alternate embodiments, those of ordinary skill in the art will understand that numerous other embodiments have been enabled such other embodiments shall be included within the scope and meaning of the appended claim.

What is claimed is:

1. A quick secure connection system for a set of outdoor lights connected to a power source, said quick secure connection system comprising:

a separate mounting block affixed in each light fixture in the set of outdoor lights, each of said mounting blocks including a pair of wires electrically connected to a light source in said respective light fixture in the set of outdoor lights;

a power cord extending away from said mounting block;

a female connector formed in said mounting block and electrically connected to said pair of wires and said power cord; said female connector being surrounded by an externally threaded housing;

a male connector electrically connected to a distal end of said power cord, said male connector constructed and arranged for interlitment with said female connector said male connector including an internally threaded collar surrounding the power cord and the male connector;

whereby electrical connection of each light in the set of outdoor lights is made by interfitment of the male connector of a first light fixture into the female connector of a second light fixture and threadable engagement of said internally threaded collar with said externally threaded housing.

2. A set of outdoor lights comprising:

a two-wired electrical power source, said power source having a main two-wired female connector formed therein, said main two-wired female connector being surrounded by an externally threaded housing;

a first light fixture assembly having a first mounting block affixed therein, said first mounting block including a first two-wired power cord extending away from said first mounting block, said first two-wired power cord having a first two-wired male connector electrically connected to a distal end of said first two-wired power cord, said first two-wired male connector constructed and arranged for interfitment with said main two-wired female connector formed in said power source; said first two-wired male connector including an internally threaded collar surrounding the first two-wired power cord and the first two-wired male connector:

a first pair of wires electrically connected to a first two-wired electrical light in said first light fixture; and a first two-wired female connector formed in said first mounting block and electrically connected to said first two-wired power cord; said first female connector being surrounded by an externally threaded housing;

a second light fixture assembly having a second mounting block affixed therein, said second mounting block including a second two-wired power cord extending away from said second mounting block, said second two-wired power cord having a second two-wired male connector electrically connected to a distal end of said second two-wired power cord, said second two-wired male connector constructed and arranged for interlitment with said first two-wired female connector formed in said first mounting block; said second two-wired male connector including an internally threaded collar surrounding the second two-wired power cord and the second two-wired male connector;

a second pair of wires electrically connected to a second two-wired electrical light in said second light fixture;

a second two-wired female connector formed in said_second mounting block and electrically connected to said second pair of wires and said second two-wired power cord; said second female connector being surrounded by an externally threaded housing;

whereby threadable connection of said main two-wired female connector formed in said power source with said first two-wired male connector will provide electrical power to said first two-wired electrical light and threadable connection of said first two-wired female connector with said second two-wired male connector will provide electrical power to said second two-wired electrical light.

3. The set of outdoor lights as defined in claim 2 wherein said two-wired electrical power source is a transformer.

4. The set of outdoor lights as defined in claim 2 wherein said two-wired electrical power source is a set of solar panels.

5. A method for creating a set of outdoor lights compromising the steps of:

forming a two-wired female electrical connector surrounded by external threads in a power source;

mounting a first light fixture assembly to said power source, wherein said first light fixture assembly includes a first mounting block affixed therein, said first mounting block including a first power cord extending away from said first mounting block, said first power cord having a first two-wired male connector electrically connected to a distal end of said first power cord, said first two-wired male connector constructed and arranged for interlitment with said two-wired female connector formed in said power source; said first two-wired male connector including an first internally threaded collar surrounding the first power cord and the first two-wired male connector;

a first pair of wires electrically connected to a first two-wired electrical light in said first light fixture:

a first two-wired female connector formed in said first mounting block and electrically connected to said first pair of wires and said first power cord; said first female connector being surrounded by an externally threaded housing;

whereby said mounting first light fixture assembly to said power source step includes inserting said first two-wired male connector into said two-wired female connector formed in said power source and rotatively coupling said first threaded collar with said external threads surrounding said two-wired female connector formed in said power source mounting a second light fixture assembly to said first light fixture assembly, wherein said second light fixture assembly includes a second mounting block affixed therein, said second mounting block including a second power cord extending away from said second mounting block, said second power cord having a second two-wired male connector electrically connected to a distal end of said second power cord, said second two-wired male connector constructed and arranged for interfitment with said first two-wired female connector; said second two-wired male connector including an second internally threaded collar surrounding the second power cord and the second two-wired male connector:

a second pair of wires electrically connected to a second two-wired electrical light in said second light fixture;

a second two-wired female connector formed in said second mounting block and electrically connected to said second pair of wires and said second power cord: said second female connector being surrounded by an externally threaded housing;

whereby said mounting second light fixture assembly to said first light fixture assembly step includes inserting said second two-wired male connector into said first two-wired female connector and rotatively coupling said second threaded collar with said externally threaded housing surrounding said first two-wired female connector formed.

6. The set of outdoor lights as defined in claim 2 further including an extender power cord section having a third two-wired female connector surrounded by external threads on one end and a third two-wired male connector surrounded by an internally threaded collar on the opposite end, whereby said third two-wired male connector is constructed and arranged for interfitment with said main, first or second two-wired female connector; and said third two-wired female connector is constructed and arranged for interfitment with said main, first or second two-wired male connector.

7. The set of outdoor lights as delined in claim 2 wherein first and second light fixtures each include a ground engaging stake affixed to said respective mounting block.

8. The method as defined in claim 5 wherein said power source is house current passing through a transformer.

9. The method as defined in claim 5 wherein said power source is a set of solar panels.

* * * * *